US008183483B2

(12) United States Patent
Gottschalk et al.

(10) Patent No.: US 8,183,483 B2
(45) Date of Patent: May 22, 2012

(54) ELECTRICAL SWITCHING APPARATUS AND SHAFT ASSEMBLY THEREFOR

(75) Inventors: Andrew L. Gottschalk, Pittsburgh, PA (US); Robert Michael Slepian, Murrysville, PA (US); Thomas Alan Whitaker, North Huntington, PA (US)

(73) Assignee: Eaton Corporation, Cleveland, OH (US)

( * ) Notice: Subject to any disclaimer, the term of this patent is extended or adjusted under 35 U.S.C. 154(b) by 435 days.

(21) Appl. No.: 12/568,254

(22) Filed: Sep. 28, 2009

(65) Prior Publication Data

US 2011/0073451 A1 Mar. 31, 2011

(51) Int. Cl.
*H01H 13/04* (2006.01)

(52) U.S. Cl. ..... 200/303; 200/50.32

(58) Field of Classification Search ..... 200/293–294, 200/303, 50.01, 50.32, 39 R, 330, 337
See application file for complete search history.

(56) References Cited

U.S. PATENT DOCUMENTS 5,794,763 A * 8/1998 Ogasawara ..... 200/401
6,015,959 A 1/2000 Slepian et al.
6,166,616 A * 12/2000 Fischer et al. ..... 335/172
6,255,926 B1 * 7/2001 Gundy et al. ..... 200/293
7,294,804 B1 11/2007 Gottschalk et al.
7,385,153 B1 6/2008 Bogdon et al.
7,449,652 B2 11/2008 Rakus et al.
7,449,653 B2 11/2008 Gibson et al.
7,518,076 B1 4/2009 Gottschalk et al.
7,518,476 B2 4/2009 Spitsberg et al.
7,570,139 B2 8/2009 Spitsberg et al.
7,829,808 B2 * 11/2010 Bogdon et al. ..... 200/293

* cited by examiner

*Primary Examiner* — Felix O Figueroa
(74) *Attorney, Agent, or Firm* — John A. Kastelic; Martin J. Moran

(57) ABSTRACT

A shaft assembly is provided for an electrical switching apparatus, such as a circuit breaker. The circuit breaker includes a housing and a pivotal shaft. The shaft assembly includes a paddle assembly comprising an elongated body including a first end and a second end disposed opposite and distal from the first end. A number of paddles extend radially outwardly from the elongated body. A support bracket is coupled to the housing of the circuit breaker. The first end of the elongated body is coupled to and supported by the pivotal shaft, and the second end of the elongated body is coupled to and supported by the support bracket. The support bracket is preferably an accessory mounting bracket. The paddle assembly preferably further includes a separate molded member. When the separate molded member moves, the elongated body moves. However, the elongated body is pivotable independently from the separate molded member.

20 Claims, 4 Drawing Sheets

ELECTRICAL SWITCHING APPARATUS AND SHAFT ASSEMBLY THEREFOR

BACKGROUND

1. Field

The disclosed concept relates generally to electrical switching apparatus and, more particularly to electrical switching apparatus, such as circuit breakers. The disclosed concept also relates to shaft assemblies.

2. Background Information

Electrical switching apparatus, such as circuit breakers, as well as transfer switches, network protectors and the like, are often equipped with accessories such as, for example and without limitation, auxiliary switches, shunt trip devices, under voltage release devices, and bell alarms. Such devices can be employed in a variety of ways to provide signals indicating certain conditions within the apparatus and/or to initiate a change in status of the apparatus such as, for example, to trip open the separable contacts of the apparatus in response to an electrical fault condition (e.g., without limitation, current overload; short circuit; abnormal voltage).

Some of these accessories include an actuator, such as a stem or plunger, that is movable from a retracted position to an extended position in which it is structured to engage and actuate (e.g., pivot) a corresponding shaft assembly (e.g., without limitation, trip bar; D-shaft) associated with the circuit breaker operating mechanism. Accordingly, it will be appreciated that such shaft assemblies can be employed in cooperation with a wide variety of different accessories to facilitate circuit breaker operations.

Typically, the trip bar or D-shaft is pivotally supported by bearings, with an end of the shaft extending through and beyond one of the bearings such that it is cantilevered with respect thereto. The cantilevered end of the shaft includes a number of protrusions (e.g., without limitation, paddles) extending radially outwardly from the shaft. Each actuator (e.g., without limitation, stem; plunger) of the aforementioned accessories engages and moves a corresponding one of the paddles in order to pivot the shaft and initiate the desired circuit breaker operation. Among other disadvantages, such shaft assemblies are reliant upon strict, difficult to achieve tolerances with respect to shaft assembly components, and relatively minimal misalignment among the assembly components can cause the shaft assembly, and thus the circuit breaker, to not function properly.

There is, therefore, room for improvement in electrical switching apparatus, such as circuit breakers, and in shaft assemblies therefor.

SUMMARY

These needs and others are met by embodiments of the disclosed concept, which are directed to a shaft assembly for an electrical switching apparatus, such as a circuit breaker. Among other benefits, the shaft assembly employs a paddle assembly that addresses and overcomes tolerance and misalignment problems associated with known shaft assemblies.

As one aspect of the disclosed concept, a shaft assembly is provided for an electrical switching apparatus. The electrical switching apparatus includes a housing and a pivotal shaft. The shaft assembly comprises: a paddle assembly comprising an elongated body including a first end and a second end disposed opposite and distal from the first end, and a number of paddles extending radially outwardly from the elongated body; and a support bracket structured to be coupled to the housing of the electrical switching apparatus. The first end of the elongated body is structured to be coupled to and supported by the pivotal shaft, and the second end of the elongated body is coupled to and supported by the support bracket.

The support bracket may be an accessory mounting bracket. The accessory mounting bracket may further comprise a first end, a second end disposed opposite and distal from the first end of the accessory mounting bracket, plurality of fasteners, and a removable accessory tray. A first number of the fasteners may be structured to fasten the first end of the accessory mounting bracket to the housing of the electrical switching apparatus, and a second number of the fasteners may be structured to fasten the second end of the accessory mounting bracket to the housing of the electrical switching apparatus.

As another aspect of the disclosed concept, an electrical switching apparatus comprises: a housing; separable contacts enclosed by the housing; an operating mechanism structured to open and close the separable contacts, the operating mechanism including a pivotal shaft; and a shaft assembly comprising: a paddle assembly comprising an elongated body including a first end and a second end disposed opposite and distal from the first end, and a number of paddles extending radially outwardly from the elongated body, and a support bracket coupled to the housing. The first end of the elongated body is coupled to and supported by the pivotal shaft, and the second end of the elongated body is coupled to and supported by the support bracket.

The paddle assembly may further comprise a separate molded member movably coupled to the elongated body wherein, responsive to movement of the separate molded member, the elongated body moves with the separate molded member, and wherein the elongated body is pivotable independently with respect to the separate molded member. The separate molded member may be a pivotal molded ring, and the first end of the elongated body may extend through the pivotal molded ring. The pivotal molded ring may include an accessory paddle and a contact portion, and the paddle assembly may further comprise a molded projection projecting radially outwardly from the elongated body wherein, when the pivotal molded ring pivots, the contact portion engages the molded projection, thereby pivoting the elongated body.

The electrical switching apparatus may be a circuit breaker, wherein the circuit breaker further comprises a trip actuator and a number of accessories. Each of the trip actuator and the number of accessories may include an actuator. The accessory paddle of the molded ring may cooperate with the actuator of the trip actuator, and each of the paddles of the paddle assembly may cooperate with the actuator of a corresponding one of the number of accessories.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
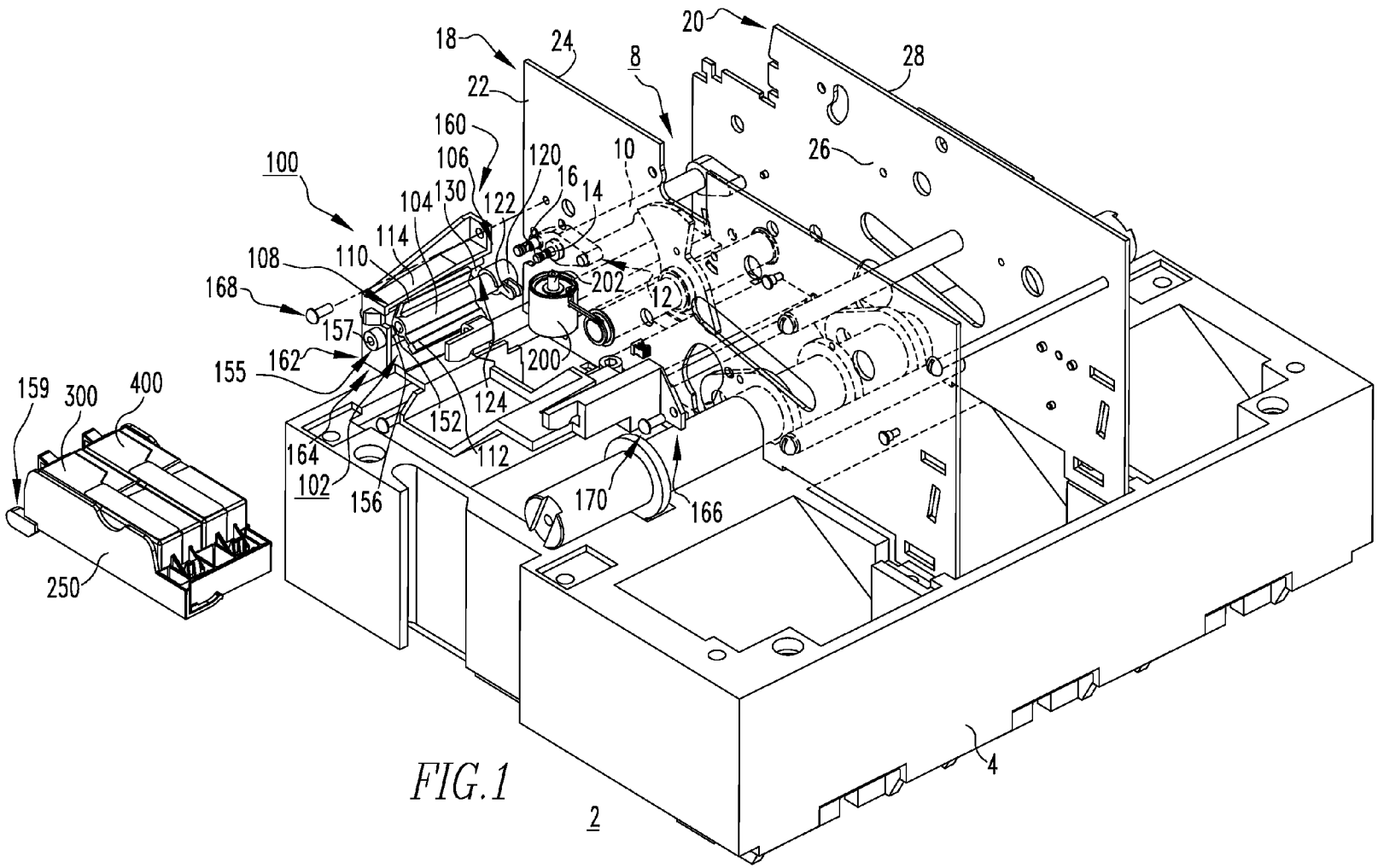
FIG. 1 is a partially exploded isometric view of a portion of a circuit breaker and a shaft assembly therefor, in accordance with an embodiment of the disclosed concept.

Directional phrases used herein, such as, for example, clockwise, counterclockwise, upwards, downwards and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, rivets, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
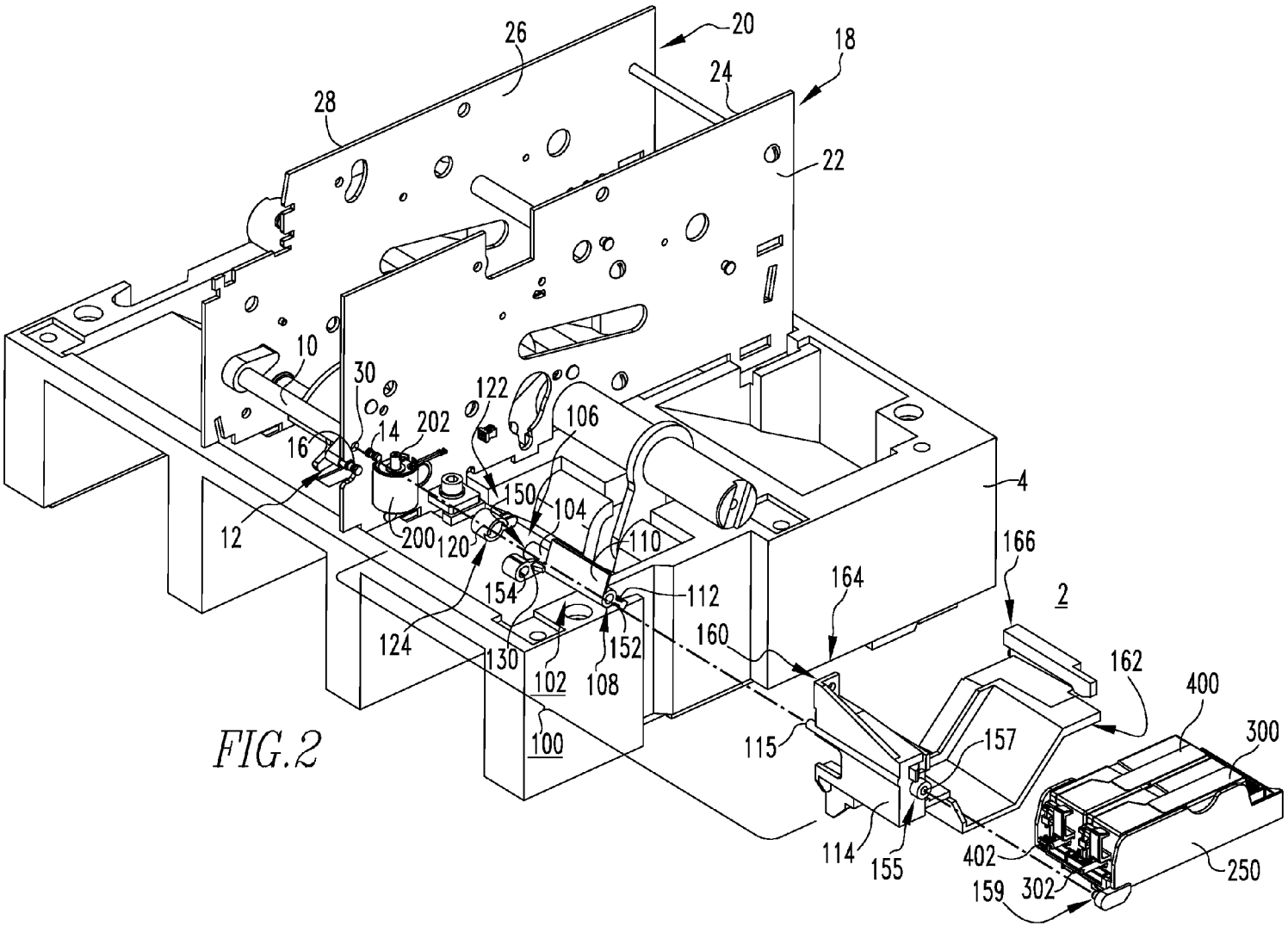
FIG. 2 is another partially exploded isometric view of the portion of the circuit breaker and the shaft assembly therefor of FIG. 1.
Figure 3A:
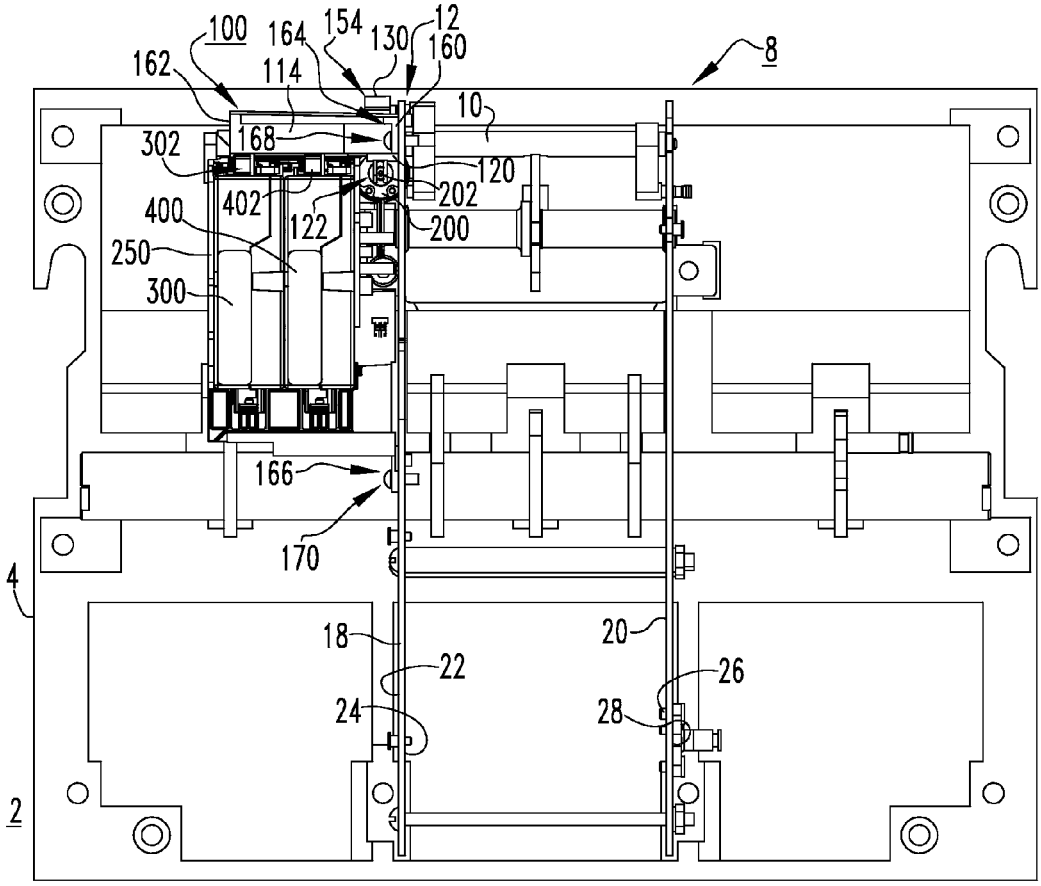
FIGS. 3A and 3B are top plan and side elevation views, respectively, of the portion of the circuit breaker and the shaft assembly therefor of FIG. 2.
Figure 3B:
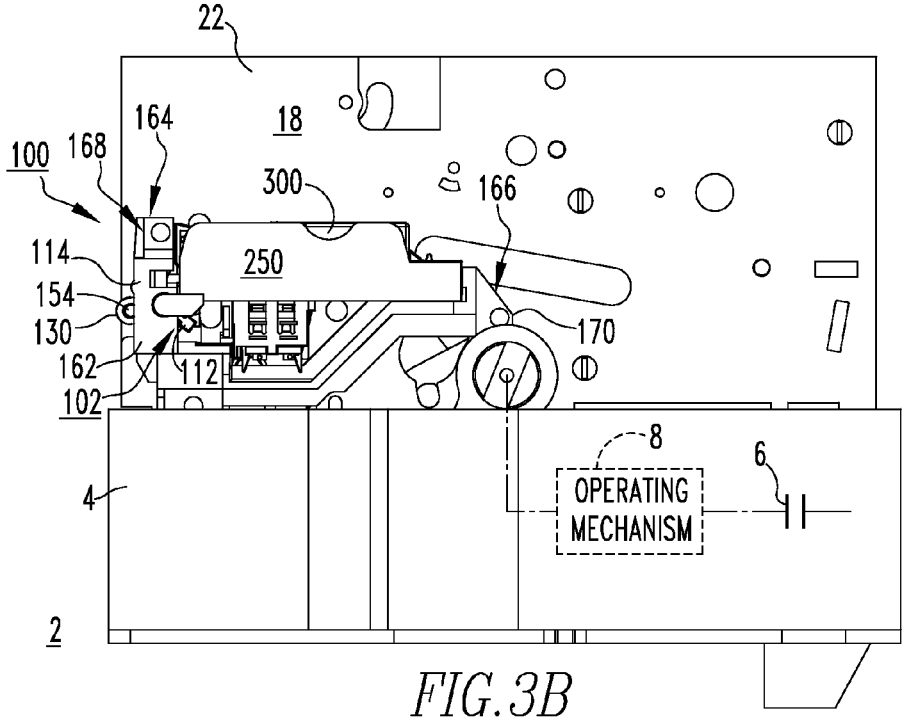

FIGS. 1-3B show a shaft assembly 100 for an electrical switching apparatus such as, for example and without limitation, the circuit breaker 2, which is partially shown. The example circuit breaker 2 includes a housing 4, separable contacts 6 (FIG. 3B) enclosed by the housing 4, and an operating mechanism 8 (shown in simplified form in hidden line drawing in FIG. 3B) (also indicated generally by reference numeral 8 in FIGS. 1, 3A, 4 and 5), which is structured to open and close the separable contact 6 (FIG. 3B). As shown in FIGS. 1-3A, 4 and 5, the operating mechanism 8 includes a pivotal shaft, which in the non-limiting example shown and described herein is a D-shaft 10.

The example shaft assembly 100 includes a paddle assembly 102 having an elongated body 104 with first and second opposing ends 106,108. A number of paddles 110,112 (best shown in FIGS. 4 and 5) extend radially outwardly from the elongated body 104. Although two paddles 110,112 are shown, it will be appreciated that any known or suitable alternative number and/or configuration of paddles (not shown) could be employed, without departing from the disclosed concept. A support bracket 114 is structured to be coupled to the circuit breaker housing 4, as will be described in greater detail hereinbelow. Thus, the first end 106 of the elongated body 104 is coupled to and supported by the pivotal shaft 10 (e.g., without limitation, D-shaft) of the circuit breaker 2, and the second end 108 of the elongated body 104 is coupled to and supported by the support bracket 114. In this manner, the shaft assembly 100 and, in particular, the elongated body 104 of the paddle assembly 102 is well supported at both ends 106,108. Among other benefits, this enables the disclosed shaft assembly 100 to overcome misalignment and costly tolerance disadvantages associated with known shaft assemblies. More specifically, the elongated body 104 is relatively short and the various features (e.g., without limitation, paddle assembly 102; paddles 110,112; support bracket 114; removable accessory tray 250) of the shaft assembly 100 are disposed relatively close to one another and/or to a supporting element of the circuit breaker housing 4 (e.g., without limitation, side plate 18, discussed hereinbelow). The close proximity of the assembly components makes it easier to achieve relatively close tolerances because, for example and without limitation, effects of mold shrinkages on tolerance stack-ups, is minimized. Additionally, the removable accessory tray 250 (described hereinbelow) and support bracket 114 are coupled to the first side 22 of the side plate 18 close to the pivot point (e.g., pivot axis) of the pivotal shaft 10 (e.g., without limitation, D-shaft). This alignment and close proximity further addresses potential tolerance issues. It also effectively removes the housing 4 from the tolerance stack.

In other words, as will be described in greater detail hereinbelow, the shaft assembly 100 essentially comprises a separate sub-assembly that attaches to and forms an extension of the pivotal shaft 10 (e.g., without limitation, D-shaft) of the circuit breaker 2. The elongated body 104 of the paddle assembly 102 of the shaft assembly 100 is preferably movable with, but not independently with respect to, the pivotal shaft 10, whereas the elongated body 104 of the paddle assembly 102 does pivot with respect to the support bracket 114.

Figure 4:
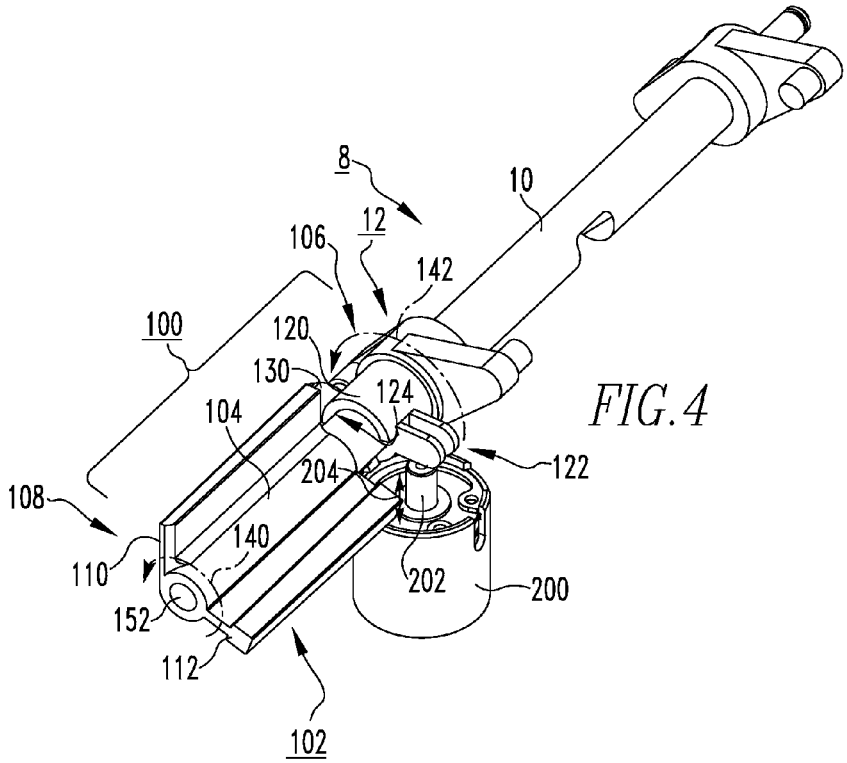
FIG. 4 is an isometric view of the shaft assembly of FIG. 3B.
Figure 5:
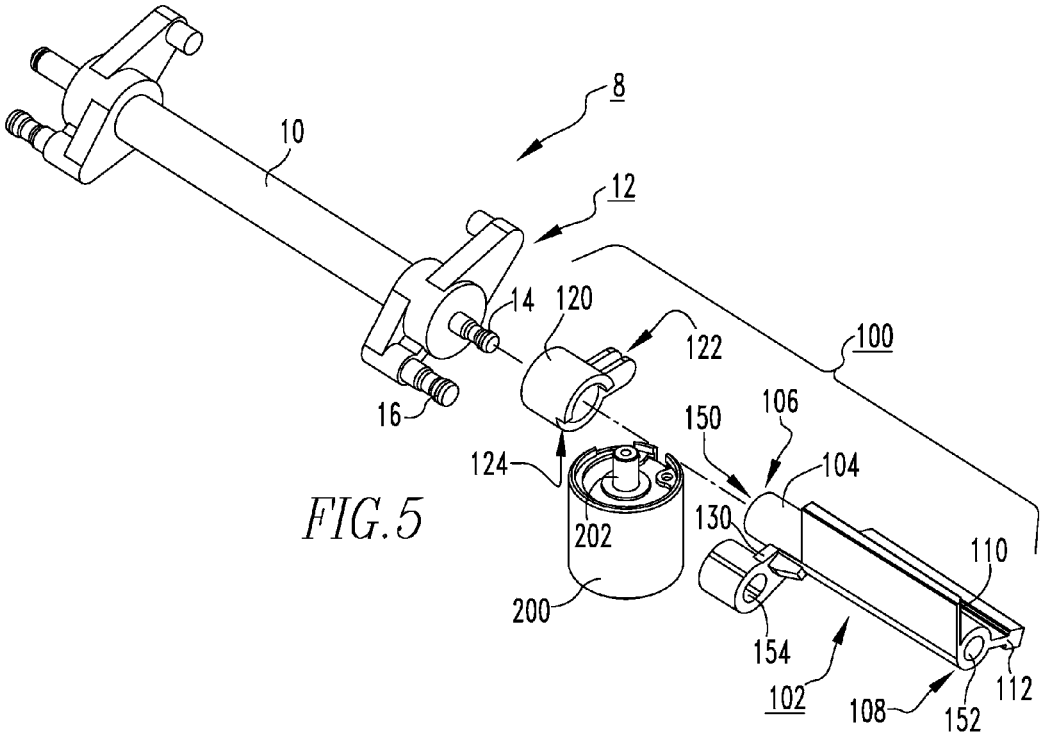
FIG. 5 is an exploded isometric view of the shaft assembly of FIG. 4.

Another unique feature of the shaft assembly 100 can be further appreciated with reference to FIGS. 4 and 5. Specifically, the example paddle assembly 102 further includes a separate mold member 120, which in the example shown and described herein is a pivotal molded ring. The first end 106 of the elongated body 104 of the shaft assembly 100 extends through the molded ring 120. Thus, the pivotal molded ring 120 is movably coupled to the elongated body 104 such that, in response to movement of the molded ring 120, for example when the actuator (e.g., stem 202) of the trip actuator 200 moves upward (e.g., from the perspective of FIGS. 4 and 5) in the direction of arrow 204 and engages the accessory paddle 122 of the molded ring 120, the molded ring 120 pivots counterclockwise (e.g., from the perspective of FIG. 4) in the direction of arrow 142 of FIG. 4. A contact portion 124 of the molded ring 120 engages a molded projection 130 that projects radially outwardly from the elongated body 104, as best shown in FIG. 5. Hence, responsive to movement of the separate molded member 120 (e.g., without limitation, pivotal molded ring), the elongated body 104 of the paddle assembly 102 also moves along with the molded ring 120. However, it will be appreciated that the elongated body 104 is pivotable independently with respect to the molded ring 120. That is, one or more of the paddles 110,112 of the paddle assembly 102 can be engaged and moved to pivot the paddle assembly 102 and elongated shaft 104 counterclockwise (e.g., from the perspective of FIG. 4) in the direction of arrow 140 of FIG. 4, without pivoting the aforementioned separate molded ring 120.

The manner in which the shaft assembly 100 is supported will now be described in greater detail. Specifically, as shown in FIG. 5, the first end 106 of the elongated body 104 of the example shaft assembly 100 includes a first socket 150, and the second end 108 includes a second socket 152. The aforementioned molded projection 130 of the paddle assembly 102, which projects radially outwardly from the elongated body 104, includes a third socket 154, as shown. The pivotable shaft 10 (e.g., without limitation, D-shaft) of the circuit breaker 2 (FIGS. 1-3B) includes an attachment interface 12 having a first protrusion 14 and a second protrusion 16. The example support bracket 114, includes a pin 155 having a third protrusion 156 and fourth socket 157, as best shown in FIG. 1, and the aforementioned removable accessory tray 250, which has a fourth protrusion 159, best shown in FIG. 2. It will, therefore, be appreciated that the first socket 150 receives the first protrusion 14 of the attachment interface 12 of the pivotal shaft 10, and the third socket 154 receives the second protrusion 16 of the attachment interface 12. In this manner, two ball joints are effectively formed by the interaction of the first protrusion 14 and first socket 150 and the interaction of the second protrusion 16 and third socket 154, respectively. Similarly, a third ball joint is effectively formed by the second socket 152 at the second end 108 of the elongated member 104 receiving the third protrusion 156 of the pin 155 of the support bracket 114 and the fourth socket 157 of the pin 155 receiving the fourth protrusion 159 of the removable accessory tray 250. It will, however, be appreciated that any known or suitable alternative number, type and/or configuration of supporting mechanisms (e.g., without limitation, pins; protrusions; sockets) could be employed to effectively support the first and second ends 106,108 of the elongated body 104 of the shaft assembly 100. For example and without limitation, it is foreseeable that the aforementioned protrusion and socket arrangement could be reversed such that, for example, some or all of the components that were described hereinabove as including a protrusion, instead included a recess, and vice-versa.

A still further unique aspect of the disclosed shaft assembly 100 is that the support bracket is preferably an integral accessory mounting bracket 114, as shown in the example of FIGS. 1-3B. Specifically, the accessory mounting bracket 114 includes first and second opposing sides 160,162, wherein the first side 160 is coupled to the circuit breaker housing 4 and the second side extends outwardly from the circuit breaker housing 4 and supports the second end 108 of the elongated body 104 of the paddle assembly 102, as previously described. Thus, the paddle assembly 102 extends between the first and second sides 160,162 of the accessory mounting bracket 114, as best shown in FIG. 1.

The example circuit breaker 2 includes first and second side plates 18,20 disposed opposite and spaced apart from one another, as shown in FIGS. 1-3A. The first side plate 18 includes first and second opposing sides 22,24 and the second side plate 20 includes first and second opposing sides 26,28. The shaft assembly 100 is disposed on the first side 22 of the first side plate 18, whereas the pivotal shaft 10 is disposed between the first and second side plates 18,20 on the second side 24 of the first side plate 18 opposite the elongated body 104 of the shaft assembly 100. Accordingly, the first end 106 of the elongated body 104 of paddle assembly 102 of the shaft assembly 100 is coupled to and supported by the pivotal shaft 10 at or about the first side 22 of the first side plate 18. Additionally, the example accessory mounting bracket 114 includes a locating extension 115, which is structured to be inserted into a corresponding locating hole 30 of the side plate 18 to properly position the accessory mounting bracket 114 with respect to the side plate 18. In this manner, the accessory mounting bracket 114 and removable accessory tray 250 are attached to the first side 22 of the side plate 18 in close proximity to the pivotal shaft 10, and in substantial alignment with the axis of rotation of the pivotal shaft 10. These factors lessen the susceptibility of the shaft assembly 100 to misalignment and tolerance-related issues that plague prior art shaft assemblies. A still further advantage of the disclosed concept is that the housing 4 of the circuit breaker 2 is essentially removed (i.e., eliminated from) the tolerance stack between components of the shaft assembly 100, because the shaft assembly 100 is attached directly to the pivotal shaft 10 and side plate 18.

More specifically, the example accessory mounting bracket 114 further includes first and second opposing ends 164,166 and a plurality of fasteners 168,170 (two fasteners 168,170 are shown in the example of FIGS. 1, 3A and 3B). A first number of the fasteners 168 fastens the first end 164 of the accessory mounting bracket 114 to the circuit breaker housing 4, and a second number of the fasteners 170 fastens the second end 166 of the accessory mounting bracket 114 to the circuit breaker housing 4, as best shown in FIGS. 1, 3A and 3B. It will, however, be appreciated that any known or suitable alternative number, type and/or configuration of fasteners (not shown) could be employed, without departing from the scope of the disclosed concept.

In view of the foregoing, it will be appreciated that the accessory mounting bracket 114 functions not only to support the shaft assembly 100, but also removably receives the aforementioned removable accessory tray 250 and a number of accessories such as, for example and without limitation, the first and second accessories 300,400, which are mounted thereto as shown in the example of FIGS. 1, 2 and 3A (see also accessory 300 in FIG. 3B). Each of the example accessories 300,400 includes an actuator 302,402, respectively, which in the example shown and described herein is a retractable and extendable stem or plunger. Similarly, as previously described, the example circuit breaker 2 includes a primary trip actuator 200 with a stem or plunger 202 that is retractable and extendable in the direction of arrow 204 of FIG. 4. Accordingly, it will be appreciated that the accessory paddle 122 of the aforementioned pivotal molded ring 120 cooperates with the stem or plunger 202 of the primary trip actuator 200, and each of the paddles 110,112 of the aforementioned paddle assembly 102 cooperates with a corresponding actuator 302,402 of a corresponding one of the accessories 300,400 in order to move (e.g., pivot) the elongated body 104 of the shaft assembly 100 and/or the molded ring 120 of the shaft assembly 100 to correspondingly move (e.g., pivot) the pivotal shaft 10 (e.g., without limitation D-shaft) of the circuit breaker 2, as described hereinabove. It will, however, be appreciated that the accessory mounting bracket 114 could be employed with any alternative number, type and/or configuration of accessories other than the first and second accessories 300,400 generally shown and described herein.

Accordingly, the disclosed shaft assembly provides an efficient and effective mechanism for transferring movement from, for example and without limitation, a primary trip actuator 200 and/or any known or suitable number, type and configuration of circuit breaker accessories (e.g., 300,400) to facilitate various circuit breaker operations, as desired. Among other benefits, the shaft assembly 100 is well supported and is configured so as to overcome the misalignment and tolerance problems known to be associated with prior art shaft assembly designs (not shown).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A shaft assembly for an electrical switching apparatus, said electrical switching apparatus including a housing and a pivotal shaft, said shaft assembly comprising:

a paddle assembly comprising an elongated body including a first end and a second end disposed opposite and distal from the first end, and a number of paddles extending radially outwardly from said elongated body; and a support bracket structured to be coupled to the housing of said electrical switching apparatus, wherein the first end of said elongated body is structured to be coupled to and supported by said pivotal shaft, and wherein the second end of said elongated body is coupled to and supported by said support bracket.

2. The shaft assembly of claim 1 wherein said elongated body of said paddle assembly is structured to move with but not independently with respect to said pivotal shaft; and wherein said elongated body of said paddle assembly pivots with respect to said support bracket.

3. The shaft assembly of claim 1 wherein said paddle assembly further comprises a separate molded member movably coupled to said elongated body; wherein, responsive to movement of said separate molded member, said elongated body moves with said separate molded member; and wherein said elongated body is pivotable independently with respect to said separate molded member.

4. The shaft assembly of claim 3 wherein said separate molded member is a pivotal molded ring; and wherein the first end of said elongated body extends through said pivotal molded ring.

5. The shaft assembly of claim 4 wherein said pivotal molded ring includes an accessory paddle and a contact portion; wherein said paddle assembly further comprises a molded projection projecting radially outwardly from said elongated body; and wherein, when said pivotal molded ring pivots, said contact portion engages said molded projection, thereby pivoting said elongated body.

6. The shaft assembly of claim 1 wherein each of the first end of said elongated body, the second end of said elongated body, said pivotal shaft of said electrical switching apparatus, and said support bracket includes at least one of a socket and a protrusion; wherein said at least one of a socket and a protrusion of said pivotal shaft cooperates with said at least one of a socket and a protrusion of the first end of said elongated body, in order to support the first end of said paddle assembly; and wherein said at least one of a socket and a protrusion of said support bracket cooperates with said at least one of a socket and a protrusion of the second end of said elongated body, in order to support the second end of said paddle assembly.

7. The shaft assembly of claim 6 wherein the first end of said elongated body includes a first socket; wherein the second end of said elongated body includes a second socket; wherein said paddle assembly comprises a molded projection projecting outwardly from said elongated body and including a third socket; wherein said pivotal shaft includes an attachment interface having a first protrusion and a second protrusion; wherein said support bracket comprises a pin and a removable accessory tray; wherein said pin includes a third protrusion and a fourth socket; wherein said removable accessory tray includes a fourth protrusion; wherein said first socket is structured to receive said first protrusion of the attachment interface of said pivotal shaft; wherein said third socket is structured to receive said second protrusion of the attachment interface of said pivotal shaft; wherein said second socket receives said third protrusion of said pin of said bracket; and wherein said fourth socket of said pin receives said fourth protrusion of said removable accessory tray.

8. The shaft assembly of claim 1 wherein said support bracket comprises a first side structured to be coupled to the housing of said electrical switching apparatus, and a second side disposed opposite and distal from the first side; wherein the second side supports the second end of said elongated body of said paddle assembly; and wherein said paddle assembly extends between the first side and the second side.

9. The shaft assembly of claim 8 wherein said support bracket is an accessory mounting bracket; and wherein said accessory mounting bracket further comprises a first end, a second end disposed opposite and distal from the first end of said accessory mounting bracket, and plurality of fasteners; wherein a first number of said fasteners is structured to fasten the first end of said accessory mounting bracket to the housing of said electrical switching apparatus; and wherein a second number of said fasteners is structured to fasten the second end of said accessory mounting bracket to the housing of said electrical switching apparatus.

10. An electrical switching apparatus comprising:

a housing;

separable contacts enclosed by the housing;

an operating mechanism structured to open and close said separable contacts, said operating mechanism including a pivotal shaft; and a shaft assembly comprising:

a paddle assembly comprising an elongated body including a first end and a second end disposed opposite and distal from the first end, and a number of paddles extending radially outwardly from said elongated body, and a support bracket coupled to the housing, wherein the first end of said elongated body is coupled to and supported by said pivotal shaft, and wherein the second end of said elongated body is coupled to and supported by said support bracket.

11. The electrical switching apparatus of claim 10 wherein said elongated body of said paddle assembly is structured to move with but not independently with respect to said pivotal shaft; and wherein said elongated body of said paddle assembly pivots with respect to said support bracket.

12. The electrical switching apparatus of claim 10 wherein said paddle assembly further comprises a separate molded member movably coupled to said elongated body; wherein, responsive to movement of said separate molded member, said elongated body moves with said separate molded member; and wherein said elongated body is pivotable independently with respect to said separate molded member.

13. The electrical switching apparatus of claim 12 wherein said separate molded member is a pivotal molded ring; wherein the first end of said elongated body extends through said pivotal molded ring; wherein said pivotal molded ring includes an accessory paddle and a contact portion; wherein said paddle assembly further comprises a molded projection projecting radially outwardly from said elongated body; and wherein, when said pivotal molded ring pivots, said contact portion engages said molded projection, thereby pivoting said elongated body.

14. The electrical switching apparatus of claim 13 wherein said electrical switching apparatus is a circuit breaker; wherein said circuit breaker further comprises a trip actuator and a number of accessories; wherein each of said trip actuator and said number of accessories includes an actuator; wherein said accessory paddle of said molded ring cooperates with the actuator of said trip actuator; and wherein each of said paddles of said paddle assembly cooperates with the actuator of a corresponding one of said number of accessories.

15. The electrical switching apparatus of claim 10 wherein each of the first end of said elongated body, the second end of said elongated body, said pivotal shaft of said electrical switching apparatus, and said support bracket includes at least one of a socket and a protrusion; wherein said at least one of a socket and a protrusion of said pivotal shaft cooperates with said at least one of a socket and a protrusion of the first end of said elongated body, in order to support the first end of said paddle assembly; and wherein said at least one of a socket and a protrusion of said support bracket cooperates with said at least one of a socket and a protrusion of the second end of said elongated body, in order to support the second end of said paddle assembly.

16. The electrical switching apparatus of claim 15 wherein the first end of said elongated body includes a first socket;

wherein the second end of said elongated body includes a second socket; wherein said paddle assembly comprises a molded projection projecting outwardly from said elongated body and including a third socket; wherein said pivotal shaft includes an attachment interface having a first protrusion and a second protrusion; wherein said support bracket comprises a pin and a removable accessory tray; wherein said pin includes a third protrusion and a fourth socket; wherein said removable accessory tray includes a fourth protrusion; wherein said first socket is structured to receive said first protrusion of the attachment interface of said pivotal shaft; wherein said third socket is structured to receive said second protrusion of the attachment interface of said pivotal shaft; wherein said second socket receives said third protrusion of said pin of said support bracket; and wherein said fourth socket of said pin receives said fourth protrusion of said removable accessory tray.

17. The electrical switching apparatus of claim 10 wherein said support bracket comprises a first side structured to be coupled to the housing of said electrical switching apparatus, and a second side disposed opposite and distal from the first side; wherein the second side supports the second end of said elongated body of said paddle assembly; and wherein said paddle assembly extends between the first side and the second side.

18. The electrical switching apparatus of claim 17 wherein said support bracket is an accessory mounting bracket; wherein said accessory mounting bracket further comprises a first end, a second end disposed opposite and distal from the first end of said accessory mounting bracket, a plurality of fasteners, and a removable accessory tray; wherein a first number of said fasteners is structured to fasten the first end of said accessory mounting bracket to the housing of said electrical switching apparatus; and wherein a second number of said fasteners is structured to fasten the second end of said accessory mounting bracket to the housing of said electrical switching apparatus.

19. The electrical switching apparatus of claim 18 said electrical switching apparatus includes a number of side plates each having a first side and a second side; wherein said shaft assembly is disposed on the first side of a corresponding one of said side plates; wherein said accessory mounting bracket further comprises a locating extension; wherein said locating extension is structured to engage the first side of said corresponding one of said side plates to properly position said accessory mounting bracket with respect to said corresponding one of said side plates; wherein said first number of fasteners are structured to be inserted through the first end of said accessory mounting bracket to fasten the first side of said accessory mounting bracket to the first side of said corresponding one of said side plates; and wherein said second number of fasteners are structured to be inserted through the second end of said accessory mounting bracket to further fasten the first side of said accessory mounting bracket to the first side of said corresponding one of said side plates.

20. The electrical switching apparatus of claim 19 wherein said electrical switching apparatus is a circuit breaker; wherein said number of side plates is a first side plate extending outwardly from the housing of said circuit breaker and a second side plate extending outwardly from the housing of said circuit breaker opposite and spaced apart from the first side plate; wherein said shaft assembly is disposed on the first side of said first side plate; wherein said pivotal shaft of said circuit breaker is a D-shaft; wherein said D-shaft extends between said first side plate and said second side plate on the second side of said first side plate; and wherein the first end of said elongated body of said paddle assembly of said shaft assembly is coupled to and supported by said D-shaft at or about the first side of said first side plate.

* * * * *